United States Patent [19]

Armstrong

[11] Patent Number: 4,836,075

[45] Date of Patent: Jun. 6, 1989

[54] MUSICAL CUBE

[75] Inventor: Tchaun Armstrong, Nothglenn, Colo.

[73] Assignee: Stone Rose Limited, Golden, Colo.

[21] Appl. No.: 108,112

[22] Filed: Oct. 14, 1987

[51] Int. Cl.[4] ..... G10H 1/00; G10H 1/34; G10H 5/04

[52] U.S. Cl. ..... 84/1.01; 84/95.2; 84/DIG. 7; 200/61.52; 446/397; 446/409; 446/485

[58] Field of Search ..... 84/1.01, DIG. 2, DIG. 7, 84/1.28, 94.1, 94.2, 95.1, 95.2; 446/397, 404, 485, 484, 409; 200/61.48, 61.51, 61.52, 61.45 R, 61.49; 340/52 H, 65, 566, 689; 273/138 A, 146, 58 E, 58 F, 58 G

[56] References Cited

U.S. PATENT DOCUMENTS

| | | | |
|---|---|---|---|
| 2,823,367 | 2/1958 | Huron | 340/689 X |
| 2,849,819 | 9/1958 | Murphy et al. | 273/58 E |
| 2,903,820 | 9/1959 | Bodell | 273/58 G |
| 3,161,737 | 12/1964 | Hall | 200/61.52 |
| 3,161,738 | 12/1964 | Hall | 200/61.52 |
| 3,304,651 | 2/1967 | Deyerl | 273/58 G X |
| 3,460,838 | 8/1969 | Greenlee, Jr. | 446/397 X |
| 3,924,376 | 12/1975 | Tsurumi | 273/146 X |
| 3,935,669 | 2/1976 | Potrzuski et al. | 446/485 |
| 3,940,142 | 2/1976 | Hinz et al. | 273/146 |
| 4,124,881 | 11/1978 | Haber et al. | 273/138 A X |
| 4,181,304 | 1/1980 | Haber | 273/146 |
| 4,490,625 | 12/1984 | Dilly | 200/61.52 |
| 4,551,114 | 11/1985 | Hyman et al. | 446/397 |
| 4,552,542 | 11/1985 | Reysman | 446/485 X |
| 4,563,160 | 1/1986 | Lee | 446/485 X |
| 4,595,200 | 6/1986 | Shishido | 273/58 G |
| 4,641,840 | 2/1987 | Larson | 273/138 A |
| 4,651,613 | 3/1987 | Harrison | 446/397 X |
| 4,662,260 | 5/1987 | Rumsey | 84/1.01 |
| 4,701,146 | 10/1987 | Swenson | 446/409 X |

FOREIGN PATENT DOCUMENTS

| | | | |
|---|---|---|---|
| 2915599 | 10/1980 | Fed. Rep. of Germany | 340/566 |
| 1567711 | 5/1969 | France | 273/146 |
| 0500700 | 11/1954 | Italy | 446/397 |
| 1391901 | 4/1975 | United Kingdom | 200/61.51 |

*Primary Examiner*—A. T. Grimley
*Assistant Examiner*—John G. Smith
*Attorney, Agent, or Firm*—H. Jay Spiegel & Associates

[57] ABSTRACT

The present invention relates to an improved musical cube. The cube includes circuitry mounted within its cubical housing with the circuitry including three two-axis switches with each such switch having a central open position and two positions, one to either side of the central position, each side position of which closes a particular unique sub-circuit. The three switches are mounted in the housing in mutually perpendicular relation and the switches combine to control the operation of six sub-circuits. In the operation of the improved musical cube, a read-only memory and synthesizer device are incorporated into a circuit with the read-only memory being pre-programmed with a distinct musical sequence for each of the six sub-circuits. When the cube is rolled or thrown, as each particular face of the housing thereof faces upwardly, a corresponding one of the six sub-circuits is closed by virtue of one of the sides of one of the three two-axis switches, thereby resulting in activation of a particular sub-circuit and the resulting playing of a predetermined tone burst followed by a predetermined melody. If the cube is rolled rapidly, only the tone bursts of the particular faces are played and, when a particular face faces upwardly, the entire melodic sequence will be played and, after a predetermined time period, the device will be deactivated.

8 Claims, 3 Drawing Sheets

57
59
53
65
67
69
71
73
75
61
63
83
65a
67a
69a
71a
73a
75a
101
77
87
51
CLOCK
INTERFACE DEVICE
OSCILLATOR SYNTHESIZER
AUDIO AMP
79
INTER-CHANGABLE READ ONLY MEMORY I.C.
4 BIT DATA BUS
4 BIT ADDRESS BUS
4 BIT MICROPROCESSOR
89
81
TIMER AND POWER CONTROL
85
55

MUSICAL CUBE

BACKGROUND OF THE INVENTION

The present invention relates to an improved musical cube. In the prior art, it is known to provide a toy with a plurality of gravity operable switches which result in certain electrical circuits being activated, however, the prior art is completely devoid of any such toy, of a cubical shape, and which includes programmed and programmable means for pre-programming tone bursts and melodies which are to be played responsive to movements of the device.

The following prior art is known to applicant:

U.S. Pat. No. 2,903,820 to Bodell discloses a flashing ball including a plurality of mercury switches which selectively activate responsive to rolling and other movements of the ball which movements and activation result in the flashing of associated lights.

U.S. Pat. No. 3,304,651 to Deyerl discloses a ball having a plurality of lights controlled by a plurality of mercury switches which, in a similar manner to the teachings of Bodell, activate responsive to movements of the ball to result in corresponding activations of the associated lamps.

U.S. Pat. No. 3,580,575 to Speeth discloses a ball including a plurality of lamps 4, 5 and 6 activated through movements of a spherical contact member 16 within fixed members 17, 18, and 19 with the movements resulting in selective activations of the respective lamps.

U.S. Pat. No. 4,651,613 to Harrison teaches the concept of a cube-shaped device having a music box on each face thereof and with the music boxes being manually activated in each case to cause a respective music box to play its tune.

Accordingly, it is seen that the prior art fails to show a musical toy which has pre-programmed therein a plurality of unique tunes which may be activated through random or selective movements of the toy.

SUMMARY OF THE INVENTION

The present invention overcomes the deficiencies found in the prior art delineated above and provides an intriguing and interesting new toy which will provide hours and hours of enjoyment by children of all ages.

The present invention includes the following interrelated aspects and features:

(a) In a first aspect, the present invention is made in a cube shape with six faces, with one of the faces comprising a slidably removable top which when removed exposes the inside of the cube-shaped housing so that access may be had to the electrical circuitry to program the read-only memories and/or change the batteries.

(b) Mounted within the cube-shaped housing is an electrical circuit including a pilot light which lights the interior of the housing and due to the translucent nature of the material of the housing causes the cube to glow. The electrical circuit includes six sub-circuits which are switch-operated.

(c) The switches which activate the six sub-circuits consist of three two-axis switches which are arranged on the circuit board in mutually perpendicular relation such that in any particular orientation of the cube with a particular face facing upwardly, only a single one of the six sub-circuits are activated due to the closing of one of the switch contacts of a particular two-axis switch.

(d) The six sub-circuits are each electrically connected to a read-only memory device which is pre-programmed with six unique musical sequences, each one of which commences with a tone burst of predetermined volume and tone followed by a particular unique tune which is designed to last for a predetermined time. Each of these musical sequences may be pre-set in the read-only memory and, if desired, provision may be made to enable the user to change one or more of the pre-programmed musical sequences.

(e) A power control sub-circuit is provided in the circuitry so that the musical cube does not continue to play indefinitely once it has been in a rest position for a predetermined period of time. The power control sub-circuit operates to begin timing the period during which the musical cube is at rest with a single particular face facing upwardly and a particular musical sequence being played. If a predetermined period of time has elapsed and the cube has not been moved, which is sensed by the microprocessor sub-circuit, the source of power, i.e. the battery, is electrically disconnected from all other sub-circuits besides the sensor switches and the timer and power control sub-circuit. When the cube is moved from its position of rest, the above described deactivation is cancelled and such movement restores normal operation of the musical cube.

(f) Each musical sequence is designed to include a preliminary tone burst followed by a predetermined musical sequence. Each tone burst and subsequent musical sequence is unique for each face and thus, when the cube is rolled or continuously moved, interesting and variable patterns of musical sequences will result.

Accordingly, it is a first object of the present invention to provide an improved musical cube device.

It is a further object of the present invention to provide an improved musical cube device with a translucent housing illuminated from within and including switch means to activate sub-circuits contained therein.

It is a still further object of the present invention to provide such an improved musical cube wherein the sub-circuits when activated each cause a unique musical sequence to be played.

It is a still further object of the present invention to provide such a device wherein when the device is at rest for a predetermined period of time, it is automatically deactivated.

These and other objects, aspects and features of the present invention will be better understood from the following detailed description of the preferred embodiments thereof when read in conjunction with the appended drawing figures.

BRIEF DESCRIPTION OF THE DRAWINGS

FIG. 1*a* shows an enlarged view of a portion of the housing during assembly.

SPECIFIC DESCRIPTION OF THE PREFERRED EMBODIMENT

Firstly, applicant would like to incorporate by reference herein disclosure document No. 164,991 filed Feb. 25, 1987.

Figure 1:
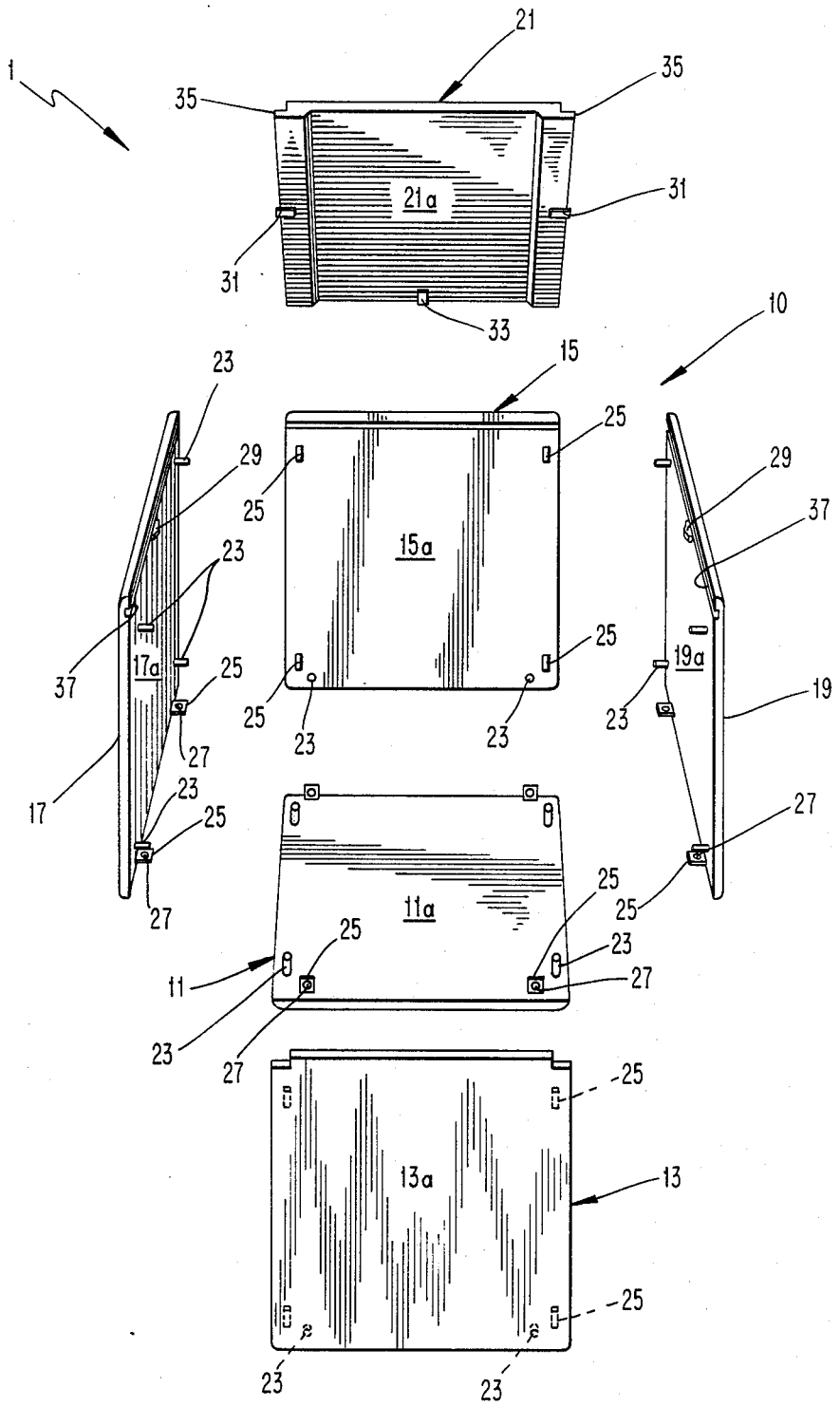
FIG. 1 shows an exploded view of the housing of the present invention.

With reference first to FIG. 1, it is seen that the present invention 1 includes a housing 10 with a bottom 11, front 13, back 15, sides 17 and 19, and top 21.

In FIG. 1, the top 21 is seen angled with respect to its assembled position. As seen in FIG. 1, the bottom 11 includes an inwardly facing face 11*a* having protruding pegs 23 and protruding tabs 25 with openings 27 therethrough extending inwardly thereof. Corresponding structures are given the same reference numerals on the other faces of the housing 10.

As should be understood, the sides 17, 19, front 13 and back 15 are assembled to the bottom 11 through insertion of respective pegs 23 into respective holes 27 of respective tabs 25. As should be understood, the final putting together of the bottom, sides, front and back must be done substantially simultaneously due to the simultaneous interaction of the respective pegs and holes which are necessary in order to complete the assembly.

With further reference to FIG. 1, it is seen that the side 17 has an inwardly facing protrusion 29 extending outwardly from the face 17*a*, which protrusion 29 corresponds to a protrusion 29 also extending outwardly from the face 19*a* of the side 19. In the view of FIG. 1, the top 21 is angled with respect to its position in assembly on the rest of the housing so that the catches 31 and 33 may be seen. When the top 21 is assembled to the rest of the housing 10, it should be understood that the peripheral edges 35 of the top 21 ride in grooves 37 formed in the faces 17*a*, 19*a* and the protrusions 31 on the top 21 are resiliently forced past the catches 29 in the faces 17*a*, 19*a* and protrusion 33 is forced past the edge of front 13 to thereby lock the top 21 in place on the rest of the housing 10. In order to disassemble the housing 10, the sides 17, 19, and top 21 must be simultaneously slightly separated apart sufficiently to allow the protrusions 31 to be slid past the catches 29 and protrusion 33 past the top edge of the front 13. Since this slight spreading of the sides 17, 19, and top 21 will require more than two hands in its accomplishment, in this way, disassembly of the housing 10 and thereby access to the interior thereof has been rendered "child-proof".

Figure 2:
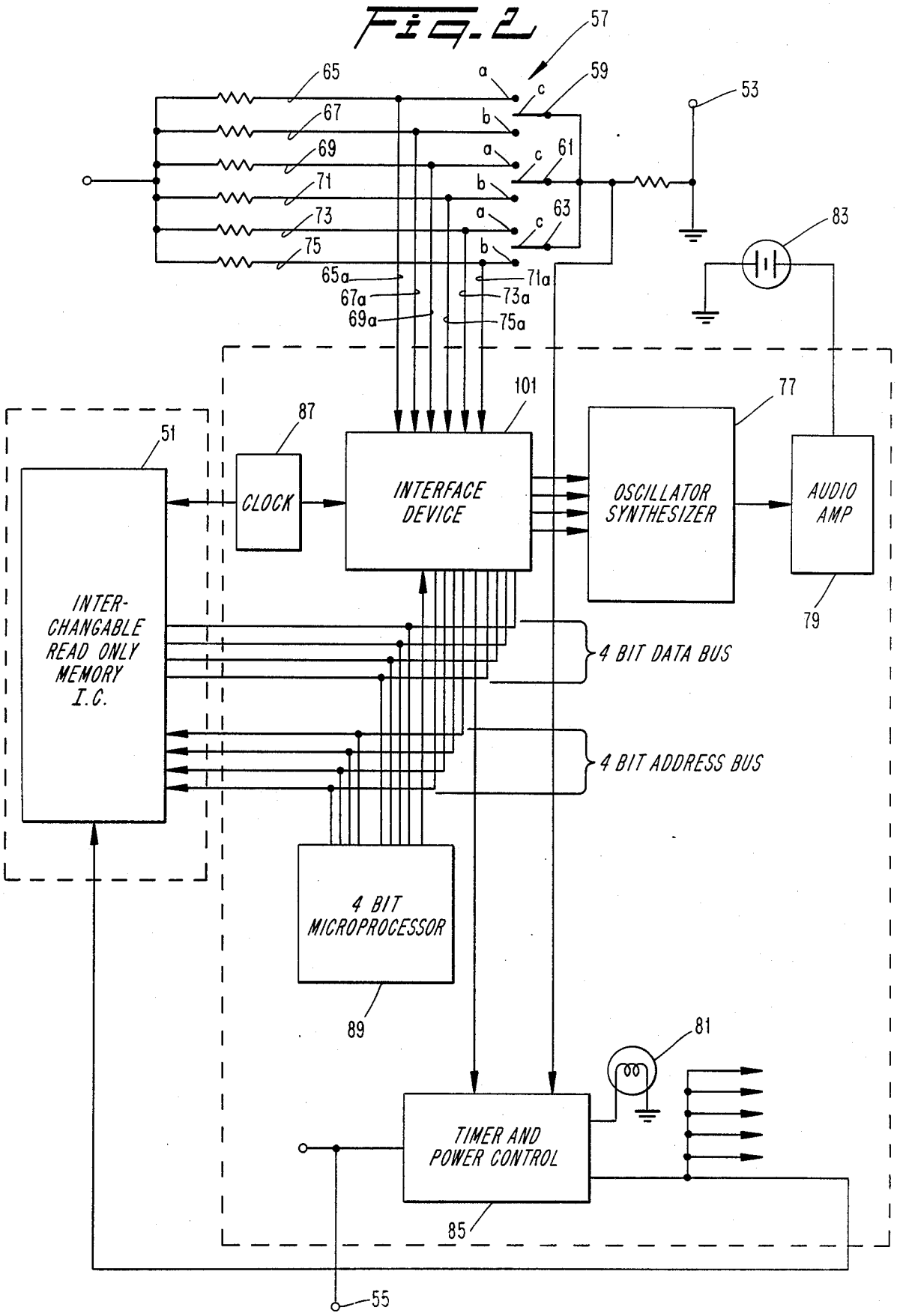
FIG. 2 shows a schematic view of the electrical circuitry of the present invention.

Reference is now made to FIG. 2, wherein a schematic representation of the inventive circuitry is shown. Therein, the invention is seen to include a microprocessor 89 and a read-only memory 51 having at least six banks. Terminals 53 and 55 are, respectively, the negative and positive terminals which are connected to the battery or batteries which provide power for the system. The system includes a switching area 57 wherein are located three two-pole gravitational axis switches 59, 61 and 63 with each of the switches being shown in a representative central position which will result in the closing of no circuits.

Figure 3:
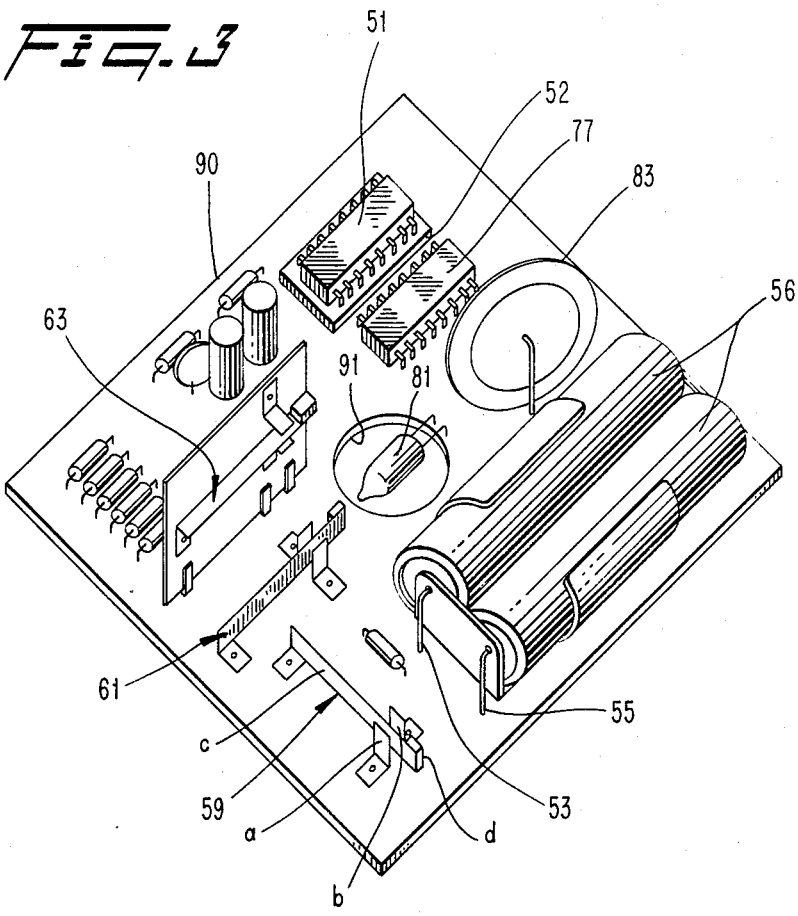
FIG. 3 shows a top perspective view of the circuit board of the present invention.
Figure 12:
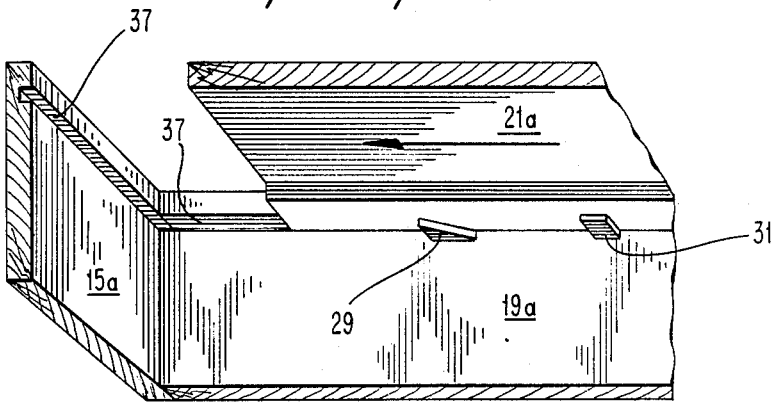

As better seen in FIG. 3, each of the switches 59, 61 and 63 includes two contacts a and b, and an elongated very thin spring leaf c having a weight d on the end thereof. When the leaf is parallel to the gravity axis due to rotations and other movements of the housing 10, the contact a or b which is below the leaf c in any such orientation will be engaged by the leaf c to thereby complete a particular sub-circuit. For simplicity, the weights are not shown in FIG. 2. The electrical conductors 65, 67, 69, 71, 73 and 75 are connected to contacts a or b as the case may be, as shown in FIG. 2, and interconnect the respective contact a or b with six sub-circuits with each sub-circuit, corresponding to a different face of the housing 10. Further, in this regard, the conductors 65*a*, 67*a*, 69*a*, 71*a*, 73*a* and 75*a* interconnect the respective six sub-circuits with the microprocessor 89 via interface device 101 in such a manner that whenever one of the sub-circuits is closed, that fact is immediately and instantaneously conveyed to the microprocessor 89. As should be understood from FIG. 3, due to the mutually perpendicular mounting of the switches 59, 61 and 63, only one of the six sub circuits may be energized at one particular instant.

The system, as best seen in FIG. 2, further includes a synthesizer 77 which may play six separate melodies which are to be supplied by ROM Bank 51, and transmitted by microprocessor 89. The system further includes an audio amplifier 79, a pilot light 81 which is always lit when the system is operative, a speaker 83 preferably of the piezo-electric type, a timer and power control 85, a clock function 87 and a microprocessor device 89. The operation and interaction of these components is as follows:

Firstly, the timer and power control 85 is specifically designed to activate and begin to time a period when the housing 10 is at rest, as detected by the fact that a single one of the axes of one of the switches 57, 59 or 61 has closed one of the sub-circuits continually. Whenever this occurs, the timer and power control 85 times out a predetermined period during which the synthesizer 77 will play the melody corresponding to the corresponding face of the housing 10 which is facing upwardly through interaction of the microprocessor 89 which has detected which face is facing upwardly through the lines 65*a*–75*a*. If, after the predetermined period of time, housing 10 has not moved, the time and power control 85 switches off power to all circuits besides itself and the switches 59, 61 and 63.

In such a circumstance, when the housing 10 is again moved to a position causing one or the other axes of one of the switches to activate, such activation, which is detected by the timer and power control 85 by the electrical pulse originating at the junction of conductors 59, 61 and 63, will cause the clock 87 to commence functioning and the microprocessor 51 will instruct the power control 85 to close the circuitry and thereby allow current to flow throughout.

The functions of the audio amplifier 79, speaker 83 and lamp 81 are self-explanatory. The location of interconnection of the lamp 81 into the circuit ensures that whenever any one of the six sub-circuits is activated and operating, the lamp 81 will be lit, resulting in illumination of the entire housing 10 due to the preferred translucent nature of the faces thereof.

The power control 85 is similar in nature to corresponding functions of a calculator which automatically turns itself off if a key has not been depressed within a predetermined period of time. In the preferred embodiment, the music synthesizer 77 is only required to have a range of approximately two octaves and needs only to broadcast in one particular type of voice; however, additional range and diversity of voices would add to the interest and entertainment value of the device.

As the present invention is contemplated, each of the read-only memory banks in the ROM 51 is pre-programmed with a particular, unique melodic line which would particularly identify the particular face of the housing 10 which is facing upwardly, thereby resulting in activation of the appropriate axis of one of the switches 59, 61 or 63. In the preferred embodiment, each melodic line is commenced with a tone burst which could consist of one or more tones played sequentially, simultaneously or sequentially and simultaneously. After a short pause after playing of the tone burst, a long sequence of tones forming a melody are then played. The melody is specifically designed in this way since, if the housing 10 is being rapidly rolled or otherwise moved, the result will be only the tone bursts being played during rolling and other moving activities, and results in the melodies only being played when the housing 10 is completely at rest with one of the faces thereof facing upwardly.

It is important to note that separation of the synthesizer function in the member 77 from the memory function of the microprocessor 89 allows re-programming of the system to change the tone bursts and melodies by changing the ROM chip 51. In this regard, the ROM chip 51 may be mounted on the circuit board as seen in FIG. 3 in a socket 52 allowing easy removal and replacement. Further, microprocessor 89 is provided to request the information from the various respective sub-circuit memory banks, each of which contains a pre-programmed tone burst and melody with the device 89 facilitating the retrieval of the particular tone burst and melody, and instructing of the synthesizer 77 to play the chosen tone burst and melody responsive to whichever face of the housing 10 is facing upwardly. Again, whenever a face of the housing 10 is facing upwardly resulting in playing of the tone burst and melody, the timer 89 will time the playing of the melodic line and will deactivate the system via the power control in element 85 whenever the device 1 is at rest for a predetermined period of time.

In the preferred embodiment, the microprocessor 89 requests information from the memory-word locations in the read-only memory 51 via a four-bit address buss. At each of the intervals corresponding to memory-word locations, a corresponding memory location will be addressed and the interval will be determined by a multiple of the clock cycle.

In the creation of the leaves c and weights d of the switches 59, 61 and 63, it should be understood that the spring-like nature of the leaves c will resist the gravitational forces which would tend to move them in one direction or the other under the influence of gravity. Thus, the weights d must be chosen so that when a particular leaf c is oriented so that its lateral extension is parallel with the ground surface and perpendicular to the force of gravity, the weight will be sufficient to overcome the force of gravity and cause the leaf to pivot to enable the leaf to engage the contact below. Thus, the weight d is chosen so as to slightly overcome the resilient restoring force of the leaf c. Alternatively, a ball-in-cage type binary switch may also be used, however, the leaf approach is believed to be superior.

Each of the switches 59, 61 and 63 has two outputs, any one of which may be chosen at any time depending upon the orientation of the device. By virtue of the conductors 65*a*–75*a*, whichever switch contact is closed will result in the choosing of a particular bank from the read only memory of the ROM section 51. If desired, an exclusive-or gate may be inserted between each bank select line 65*a*–75*a* and the interface device 101 to ensure that only one read-only memory bank is engaged at any given time. Other structures are well known to those skilled in the art which could be utilized to perform this function, including an arrangement of and gates combined with inverters. Furthermore, a one-shot timer with a time constant of, for example, 200 milliseconds could be added to the circuit to prevent extremely short duration switch contacts which could occur when the housing 10 is being moved quite rapidly.

With reference to FIG. 3, some of the components shown in FIG. 2 are seen in a typical mounting on a circuit board 90. In particular, note the opening 91 in the board 90 in which is mounted the pilot lamp 81 so that the light from the lamp 81 will be able to completely illuminate the interior of the housing 10 whenever the device is in operation. Further, the mutually perpendicular mounting relation of the switches 59, 61 and 63 is stressed. Finally, the socket 52 allowing easy removal of the chip 51 is shown.

Accordingly, an invention has been disclosed in terms of the preferred embodiment thereof which fulfills each and every one of the objects delineated hereinabove and provides an interesting and entertaining device for children of all ages. Of course, various changes, modifications and alterations in the teachings of the present invention may be contemplated by those skilled in the art without departing from the intended spirit and scope thereof. Accordingly, it is stressed that it is intended that the present invention only be limited by the terms of the appended claims.

I claim:

1. An improved musical cube comprising:

(a) a six-sided substantially cubical housing made of a material allowing light transmission therethrough, each side having a face;

(b) an electrical circuit mounted in said housing including:

(i) a microprocessor having memory means for storing six unique sound sequences, each sound sequence including at least a first sound followed by a pause followed by at least a second sound;

(ii) three two-axis switches, each said switch including a moving contact having three positions, a first position closing a first subcircuit and opening a second subcircuit, a second position closing said second subcircuit and opening said first subcircuit and a third position opening said first and second subcircuits, said electrical circuit including three first subcircuits and three second subcircuits with each subcircuit corresponding to one of said six faces, each said switch being gravity operated, said switches being mounted in said housing in mutually perpendicular relation with respect to one another, each said subcircuit being connected with said microprocessor memory means to access one particular said sound sequence;

(iii) whereby as said housing is moved, at any given instant, one of said faces may face in a predetermined direction with respect to the direction of the force of gravity, and whereby whenever any one of said faces is facing in said predetermined direction, a said switch corresponding to said one of said faces moves under the force of gravity to one of said first and second positions to thereby close a corresponding one of said six subcircuits, thereby causing at least a portion of one of said unique sound sequences to be played, said circuit causing others of said sound sequences to be played as respective others of said faces are caused to face in said predetermined direction during movements of said housing;

(iv) further wherein whenever a said subscriber is closed for a time period less than a predetermined time period, only a respective said first sound is played, and whenever a said subcircuit is closed for a time period greater than said predetermined time period, at least a portion of said second sound is played.

2. The cube of claim 1, wherein said circuit includes light means which is activated whenever said circuit is operable, said light means causing said housing to glow.

3. The cube of claim 1, wherein one of said sides includes latch structure means cooperating with four adjacent sides for preventing removal of said one of said sides, removal of said one of said sides allowing access to said circuit.

4. The cube of claim 2, further including clock means for timing the amount of time any one of said faces is facing in said predetermined direction, said clock means being connected to said microprocessor to terminate playing of the sound sequence corresponding to a respective face facing in said predetermined direction, after a predetermined time, and to deactivate said light means.

5. The cube of claim 1, wherein said moving contact of each said switch comprises a leaf spring connected to structure of said switch at one end and having a weight mounted at another end thereof.

6. The cube of claim 1, wherein said microprocessor includes means for selectively reprogramming said sound sequences.

7. The cube of claim 1, further including an amplifier for amplifying sound sequence signals and a speaker for broadcasting said signals.

8. The cube of claim 1, wherein said sound sequence comprise melodic sequences.

* * * * *

UNITED STATES PATENT AND TRADEMARK OFFICE

CERTIFICATE OF CORRECTION

PATENT NO. : 4,836,075

DATED : June 6, 1989

INVENTOR(S) : Armstrong

It is certified that error appears in the above-identified patent and that said Letters Patent is hereby corrected as shown below:

Column 7, line 5, "subscriber" should read --subcircuit--.

Signed and Sealed this

Fifteenth Day of May, 1990

*Attest:*

HARRY F. MANBECK, JR.

*Attesting Officer*

*Commissioner of Patents and Trademarks*